United States Patent [19]

Hovind

[11] Patent Number: 4,782,638

[45] Date of Patent: Nov. 8, 1988

[54] HURRICANE PROTECTOR CLIPS

[75] Inventor: John K. Hovind, Clarence, N.Y.

[73] Assignee: National Gypsum Company, Dallas, Tex.

[21] Appl. No.: 925,964

[22] Filed: Nov. 3, 1986

[51] Int. Cl.[4] ..... E04D 1/34

[52] U.S. Cl. ..... 52/547; 52/520; 52/521; 52/543; 52/553

[58] Field of Search ..... 52/543, 545, 519, 520, 52/521, 546, 547, 549, 551, 552, 553, 548, 748

[56] References Cited

U.S. PATENT DOCUMENTS

| | | | |
|---|---|---|---|
| 1,477,167 | 12/1923 | Tiecher | 52/547 |
| 1,532,421 | 4/1925 | MacInnes et al. | 52/546 |
| 1,941,216 | 12/1933 | McKlown | 52/545 |
| 2,099,632 | 11/1937 | Starr | 52/520 |
| 2,126,676 | 3/1938 | Thomas | 52/520 |
| 2,200,649 | 5/1940 | Wardle | 52/520 |
| 2,293,744 | 8/1942 | Miles et al. | 52/543 |
| 2,358,396 | 9/1944 | Hogan | 52/521 |
| 2,928,143 | 3/1960 | Newton | 52/547 |
| 3,173,229 | 3/1965 | Weber | 52/547 |
| 3,225,504 | 12/1965 | Gregoire | 52/520 |
| 3,408,786 | 11/1968 | Snyker | 52/547 |
| 3,552,078 | 1/1971 | Mattes | 52/520 |
| 3,584,426 | 6/1971 | Wargoe | 52/442 |
| 3,738,076 | 6/1973 | Kessler | 52/545 |
| 3,757,483 | 9/1973 | Torbett | 52/545 |
| 3,818,668 | 6/1974 | Charniga | 52/547 |
| 4,399,643 | 8/1983 | Hafner | 52/543 |
| 4,435,933 | 3/1984 | Krowl | 52/547 |

*Primary Examiner*—Carl D. Friedman
*Assistant Examiner*—Michael Safavi
*Attorney, Agent, or Firm*—Robert F. Hause; Laird F. Miller

[57] ABSTRACT

Post-formed vinyl siding affixed to a substructure by nails extending through a channel shaped hurricane clip disposed over the top nailing portion of the siding. A top narrow strip of the clip front leg projects outwardly a short distance to form a guide so an applicator won't drive the nail in tightly and prevent movement of the siding during expansion and contraction.

2 Claims, 1 Drawing Sheet

HURRICANE PROTECTOR CLIPS

This invention relates to reinforced affixation of thin elongate siding elements and more particularly to a channel shaped clip disposed on the top edge of thin elongate siding beneath the head of each nail or screw.

BACKGROUND OF THE INVENTION

Extruded sections of thermoplastic polyvinyl chloride siding, commonly referred to as vinyl siding, with face sections of about one millimeter thickness, are commonly used as an imitation and substitute for wooden lap siding. Recent governmental action has made it a requirement that, in certain areas subject to hurricane velocity winds, building materials must be capable of withstanding the forces that can be expected in hurricanes. Accordingly, if vinyl siding is desired in these areas, it must be applied in a manner which has been tested and proven capable of maintaining the siding in place under conditions comparable to those which exist during a hurricane. For example, a governmental requirement that has been enacted, applicable in certain seacoast areas, requires siding to withstand the negative pressures produced by a 140 mph wind. Provision of a novel structure resulting in vinyl siding withstanding a 140 mph wind would definitely be advantageous.

It has long been known that vinyl siding must be nailed to a substrate with nail applied through an elongate slot, and not tight against the vinyl siding, so that the vinyl siding is able to move relative to the nail when expansion and contraction occurs due to temperature changes.

In a more recent form of vinyl siding, referred to as post formed vinyl siding, ribs are no longer provided along each side of the nailing slots, as with prior extruded vinyl siding, to assist the applicator in gauging the depth to which a nail head was to be driven. Provision of a new means for gauging the nail head depth would be advantageous.

SUMMARY OF THE INVENTION

The present invention consists of an elongate channel shaped clip for disposition on the top nailing edge of thin elongate siding, such as vinyl siding, for reinforcing the attachment of the siding by nails inserted through elongate nailing slots. The novel clip also includes a top section which provides a gauge for guiding the applicator in driving in the nail to the proper depth.

It is an object of the present invention to provide a most simplified and economical combination of standard thin elongate siding elements with a channel shaped clip for adapting the siding for high wind resistance.

It is a further abject of the invention to provide such a combination adaptable to standard vinyl siding.

It is a still further abject to provide a novel nail depth gauge for post formed vinyl siding.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
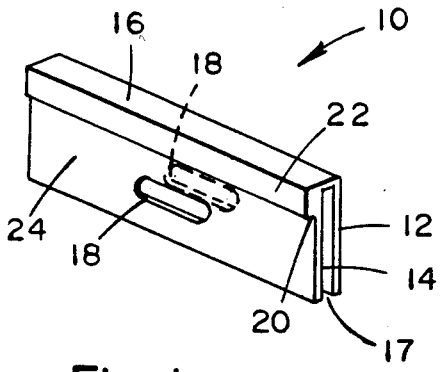
FIG. 1 is an isometric view of the novel hurricane clip for use on thin elongate siding.

Referring to FIG. 1, there is shown a novel hurricane clip 10. Clip 10 is preferably a two inch long section of an extruded rigid vinyl downwardly opening channel, including a back leg section 12, a front leg section 14 and a top connecting section 16, forming a groove 17 therewithin of about ⅛ inch width. At the center, lengthwise and vertically, of the back leg section 12 and the front leg section 14 is a lengthwise extending nail slot 18 which is about ½ inch long and 3/16 inch high.

The front leg section 14 includes a small step 20 extending lengthwise, with the top narrow strip 22 projecting outwardly about 1/16 inch relative to the bottom wide face 24 of front leg section 14.

Figure 2:
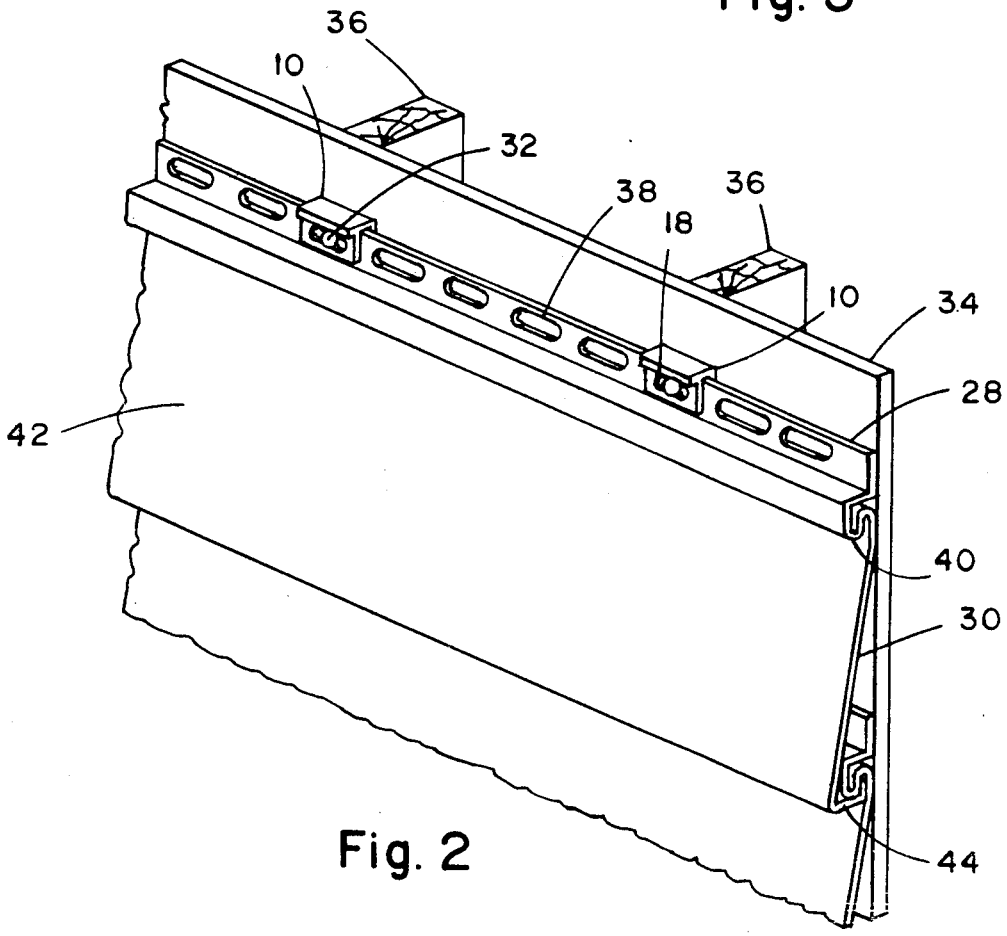
FIG. 2 is an isometric view of a section of vinyl siding attached to a building by nails extending through the novel hurricane clips.

FIG. 2 shows two hurricane clips 10 disposed over the top edge 28 of an elongate section of vinyl siding 30, with nails 32 extending through the clips 10, the siding 30, the underlying sheathing 34 and into a pair of adjacent studs 36. The nails 32 are originally, at time of application, inserted through the nail slot 18 in the clip front leg section 14, through the approximate center of one of the plurality of nail slots 38 in the top edge of the vinyl siding 30 and then through the nail slot 18 in the clip back leg section, prior to being driven on through the sheathing 34 and into the studs 36.

Clips 10, being formed of rigid vinyl, have a top connecting section 16 which can be used by the applicator as a guide and reminder to not drive the nails in so tight that they restrict movement of the siding relative to the nails 32.

The siding 30 is preferably a post-formed elongate strip of vinyl siding. In post forming vinyl siding, a flat sheet of vinyl is extruded and, while still at a high enough temperature for reforming, then reformed, as shown in FIG. 2, to include a narrow, flat top edge 28, an outwardly bent hook section 40 immediately therebelow, a main face section 42 and, at the bottom, an inwardly bent interlocking hook section 44, for engaging the outwardly bent hook portion 40 of a lower mounted, similar strip of siding 30.

The slots 38 in the narrow, flat top edge 28 are preferably about ⅛ inch by 1¼ inch, with ½ inch between adjacent slots. The hurricane clips 10 are preferably about two inches long, but could be any length from about 1½ inch to 15 inches. The wall thickness of the clips 10 is about 0.05 inch, but could be from about 0.02 inch to 0.1 inch thick. The studs 36 are normally spaced about 16 inches, center to center.

The flat top edge 28 is about ⅝ inch wide and accordingly the hurricane clips have a channel depth of about ⅝ inch so that the clips reinforce the entire width of the top edge 28.

Small test sections of vinyl siding 30 nailed to studs both with hurricane clips as described hereabove, and with just nails, have been constructed and tested to determine the force necessary to push the siding away from the studs. The use of the above described hurricane clips 10 more than doubled the resistance of the structure to failure, and with longer hurricane clips, the force required for failure was almost triple that required with just nails.

Figure 3:
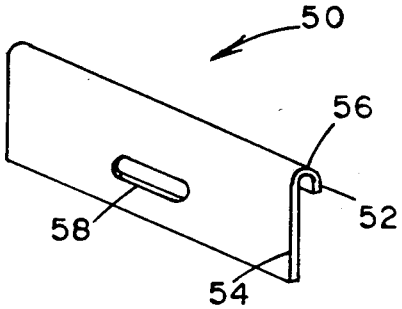
FIG. 3 is an isometric view of a modified form of hurricane clip, in accordance with the invention.

FIG. 3 shows a modified form of hurricane clip 50, wherein a short strip of sheet metal is formed into a J-cross section of about 2 inch length and $\frac{5}{8}$ inch height. Clip 50 has a relatively short back leg section 52, a front leg section 54 and a top connecting section 56. A nail slot 58 is formed in the middle of clip 50. Clip 50 is placed over the top edge of a strip of vinyl siding and nailed to studs with the siding under the clip 50 in a manner similar to the application with clip 10.

The clip 50, with a front leg section 54, which is not stepped in the manner of front leg section 14 of clip 10, is also able to provide the function of a guide to which the nail head should be driven. The nail head can be driven until it contacts the front leg section 54 so long as the clip isn't squeezed to prevent movement of the vinyl siding relative to the nail.

The novel clips of the invention can also be used to reinforce the top edge of thin siding made from materials other than vinyl siding, such as aluminum siding.

Having completed a detailed description of the preferred embodiments of my invention so that those skilled in the art may practice the same, 1 contemplate that variations may be made without departing from the essence of the invention.

I claim:

1. In combination with thin horizontal siding sections having a thin fastening portion along an upper edge portion of said siding sections, a hurricane clip for strengthening the wind resistance of exterior siding comprising a rigid elongate thin walled channel having a back leg section, a front leg section and a top connecting section, forming a downwardly opening groove therewithin of about $\frac{1}{8}$ inch width, said clip having a nail hole extending therethrough located about midway vertically of said clip, said hurricane clip being disposed over the thin fastening portion of said siding and a nail extending through the nail hole in said clip and through the thin fastening portion of said siding and into a building element disposed thereunder, in which said hurricane clip front leg section is formed with a top narrow portion and, extending downwardly therefrom, a bottom face, said top narrow portion projecting outwardly further than said bottom face of said front leg section, providing means for guiding the depth of insertion of a nail.

2. The combination of claim 1 in which said horizontal siding sections are capable of withstanding the negative pressures produced by a 140 mph wind, and in which said horizontal siding sections are post formed polyvinyl chloride.

* * * * *